US008656562B2

(12) United States Patent
Yang

(10) Patent No.: US 8,656,562 B2
(45) Date of Patent: Feb. 25, 2014

(54) STRUCTURE OF ASSEMBLING A PLASTIC LOCKING DEVICE WITH A SURFACE MATERIAL

(75) Inventor: Shih-Sheng Yang, New Taipei (TW)

(73) Assignee: Universal Trim Supply Co., Ltd., New Taipei (TW)

( * ) Notice: Subject to any disclaimer, the term of this patent is extended or adjusted under 35 U.S.C. 154(b) by 0 days.

(21) Appl. No.: 13/237,936

(22) Filed: Sep. 21, 2011

(65) Prior Publication Data

US 2012/0009045 A1 Jan. 12, 2012

Related U.S. Application Data

(63) Continuation-in-part of application No. 11/946,877, filed on Feb. 15, 2008, now abandoned.

(51) Int. Cl.
*A44B 1/32* (2006.01)

(52) U.S. Cl.
USPC ..... 24/114.4; 29/525.02; 29/524.1; 29/428; 411/508; 411/501; 411/518; 411/431; 411/340; 24/90.1; 24/114.05; 24/3.1; 24/30.5 S

(58) Field of Classification Search
USPC ..... 29/525.02, 524.1, 428, 283.5, 243.5; 411/501, 45, 516, 529, 8, 9, 14.5, 37, 411/340, 552, 348, 365, 431, 508, 518; 24/104, 453, 114.4, 90.1, 114.05, 3.1, 24/30.5 S, 313, 94
See application file for complete search history.

(56) References Cited

U.S. PATENT DOCUMENTS

| | | | | | |
|---|---|---|---|---|---|
| 1,985,032 | A | * | 12/1934 | Hoult | 446/122 |
| 2,409,352 | A | * | 10/1946 | Gill | 411/38 |
| 5,846,040 | A | * | 12/1998 | Ueno | 411/45 |
| 2004/0226189 | A1 | * | 11/2004 | Semitka | 36/50.5 |
| 2005/0227772 | A1 | * | 10/2005 | Kletecka et al. | 470/63 |
| 2008/0236341 | A1 | * | 10/2008 | Kletecka et al. | 76/101.1 |

FOREIGN PATENT DOCUMENTS

| | | | | |
|---|---|---|---|---|
| DE | 3330060 | A | * | 2/1985 |
| FR | 2825762 | A1 | * | 12/2002 |
| JP | 2003235608 | A | * | 8/2003 |

* cited by examiner

*Primary Examiner* — Peter DungBa Vo
*Assistant Examiner* — Azm Parvez
(74) *Attorney, Agent, or Firm* — Leong C. Lei

(57) ABSTRACT

A structure of assembling a plastic locking device with a surface material includes a plastic locking device. A surface material forms holes. The plastic locking device is placed to have through-holes defined therein overlapping the holes of the surface material. Rivet fastener elements are respectively put through the through-holes of the plastic locking device and the holes of the surface material to be subjected to a riveting and fixing operation. The rivet fastener element includes a male button that is made of zinc and forms a pillar and a female button that is made of zinc and forms a hollow tube. Pressurizing equipment is used to couple the pillar and the hollow tube through interference fitting between the pillar and an inner wall of the hollow tube. Locking blocks are formed on the inner wall of the hollow tube to provide a tight interference fitting with respect to the pillar.

1 Claim, 4 Drawing Sheets

STRUCTURE OF ASSEMBLING A PLASTIC LOCKING DEVICE WITH A SURFACE MATERIAL

This is a continuation-in-part of the patent application Ser. No. 11/946,877 filed Feb. 15, 2008, now abandoned.

TECHNICAL FIELD OF THE INVENTION

The present invention generally relates to a structure of assembling a plastic locking device with a surface material, and more particularly to assembling of a plastic locking device with a surface material without applying sewing, which enables the locking device after being assembled to be bonded to a surface of the surface material, for achieving an invisibility-like function and improving visual beauty of an external surface. Moreover, as there are no pinpricks of sewing, water can be prevented from permeating into the sewing places.

DESCRIPTION OF THE PRIOR ART

For a conventional backpack, bag, or cloth cover, a water-proof surface material should be always installed with a plastic locking device for insertion and assembling. Referring to FIG. 1, in a conventional technique, a section of shorter woven belt 10 is transfixed into a slot hole 21 at an end of a plastic female button 20. After the woven belt 10 has been passed through that end, it is folded reversely and sewed with a plurality of seams 11 to be firmly assembled at this end part A. In addition, the other end of the woven belt 10 is attached on a surface of the surface material 30 in flat, and is also sewed with a plurality of the seams 12 to fix this end part B. Accordingly, the surface material 30 can be surely assembled with the female button 20. However, the female button 20 is suspended and exposed at an exterior of the surface material 30, and hence entire beauty of appearance is inferior, which will affect the appearance of the backpack, bag, or cloth cover easily. Therefore, it is necessary to improve.

On the other hand, in the locking method in FIG. 1, small through-holes will occur at the pinpricks of seams 12, prohibiting the water-proof surface material 30 to achieve an effective water-proof function. As rain will enter following pores of these pinpricks, a shortcoming of insufficient water-proof capability is resulted.

SUMMARY OF THE INVENTION

Accordingly, the primary object of present invention is to provide a structure of assembling a plastic locking device with a surface material, such that entire appearance can be more beautiful after the plastic locking device has been assembled with the surface material.

Another object of the present invention is to provide a structure of assembling a plastic locking device with a surface material, so as to provide a better water-proof effect without installing pinpricks of sewing at peripheries of the locking device.

Accordingly, the structure of assembling a plastic locking device with a surface material according to the present invention includes the following features:

(1) A plastic locking device is provided, a periphery of which is provided with through-holes, and the surface material to be attached is also provided with holes. The through-holes of the plastic locking device are placed to respectively overlap the holes of the surface material. Rivet fastener elements are transfixed into the through-holes of the plastic locking device and the holes of the surface material from top and bottom sides, and then a punch pin is used for riveting and finishing, in order to couple the plastic locking device on the surface material firmly. Due to the tightness provided by being secured and coupled by the rivet fastener element, water tightness is realized.

(2) A rivet fastener element is provided, which comprises a male button that is made of zinc. The male button has a periphery that is provided with a pillar protruding downward. The surface material to be attached is also provided with holes. The pillar which is protruded on each male button is transfixed into the hole of the surface material. A female button, which is made of zinc is provided and the female button is provided with a hollow tube, such that after the pillar protruding from the male button has been transfixed into the hole of the surface material, each hollow tube is sheathed into the pillar, and pressurizing equipment is used to couple the pillar and an inner wail of the hollow tube with interference fitting for assembling purposes, thereby firmly assembling the plastic locking device on the surface material.

(3) The female button that is made of zinc is provided, on the inner wall of the hollow tube, with locking blocks that project toward a center, whereby when the male button and the female button use pressurizing equipment to couple the pillar and inner wall of the hollow tube with interference fitting for assembling purposes, the locking blocks projecting inside the hollow tube induces a tapping like interference for tight bonding to the pillar of the male button, thereby realizing excellent and tight securing effect, making the plastic locking device securely coupled to the surface material to provide a gap-free water-tight effect.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
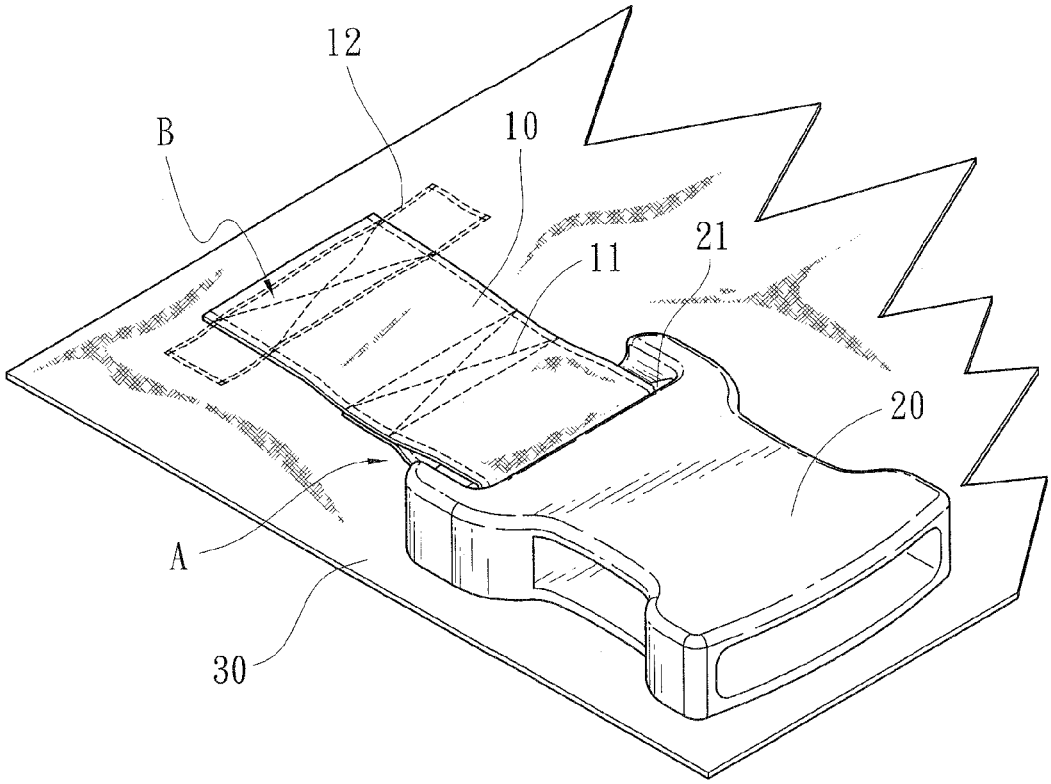
FIG. 1 PRIOR ART
FIG. 1 shows a schematic view of a conventional plastic locking device being assembled on a surface material.
Figure 2:
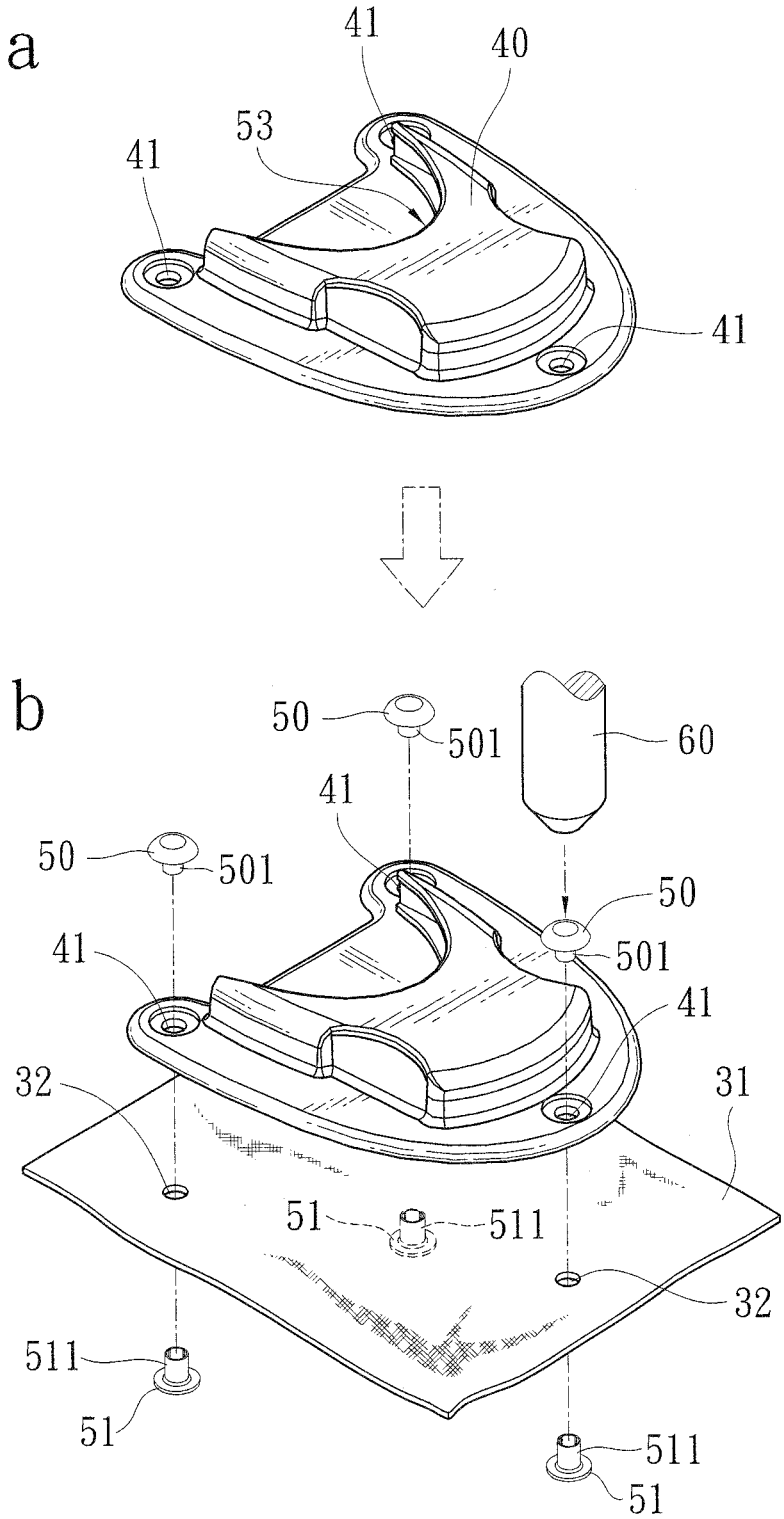
FIG. 2 shows an exploded view of the present invention.
Figure 3:
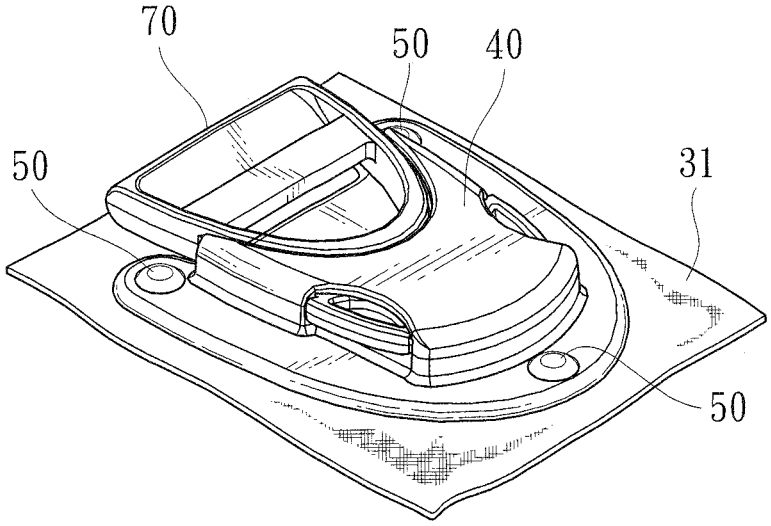
FIG. 3 shows a schematic view of the present invention which is combined with a rivet fastener element after being assembled.
Figure 4:
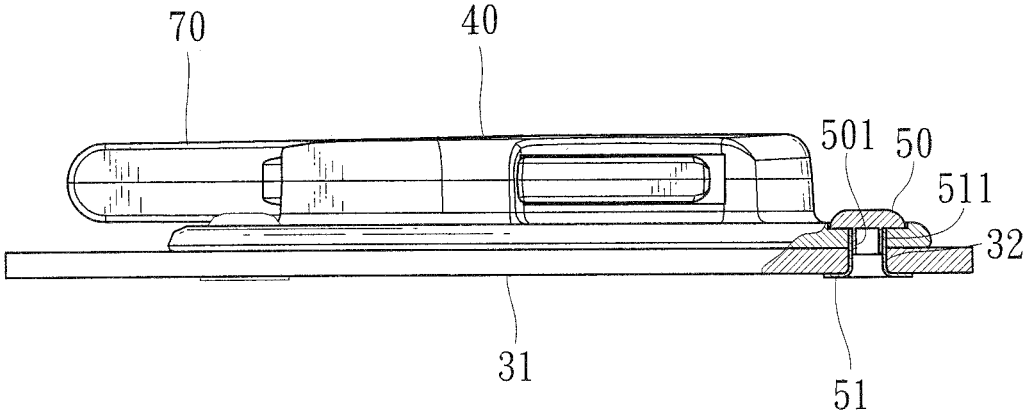
FIG. 4 shows a side elevational view of the present invention after being assembled.

Referring to FIGS. 2 to 4, an embodiment of structure of assembling a plastic locking device with a surface material is illustrated. A plastic locking device 40 is first pre-built from plastic injection molding. A periphery of the female button 40 is provided with through-holes 41. Rivet fastener elements are put, in a top side down manner, through the through-holes of the plastic locking device and holes defined in the surface material so that a subsequent riveting operation may couple them together. The rivet fastener element comprises a male button 50 and a female button 51. A plate body of the male button 50 is provided with a protruded pillar 501. A surface material 31 is provided to be attached and the surface material 31 is provided with holes 32. Through-holes 41 that are formed in the plastic locking device 40 are placed to overlap the holes 32 of the surface material 31. The rivet fastener elements 50, 51 are transfixed into the through-holes 41 of the plastic locking device 40 and the holes 32 of the surface material 31 top and bottom sides, and a punch pin 60 is used to pressurize and rivet, such that the rivet fastener elements 50, 51 are riveted to connect the plastic locking device 40 with the surface material 31 from top and bottom sides, thereby making the plastic locking device 40 more tightly set on the surface material and so coupled to the surface material to realize gap-free water tightness (as shown in FIG. 4).

Figure 5:
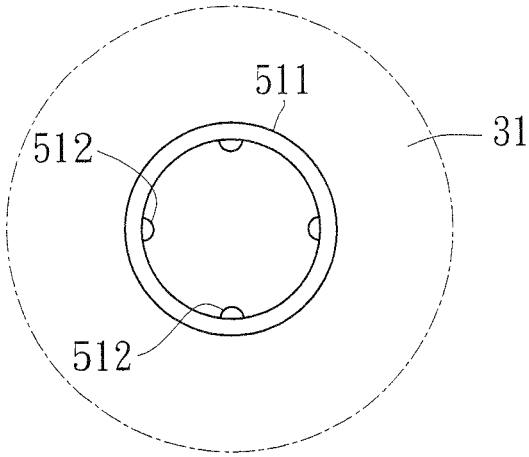
FIG. 5 shows a top plan view of a hollow tube of a female button of the present invention.
Figure 6:
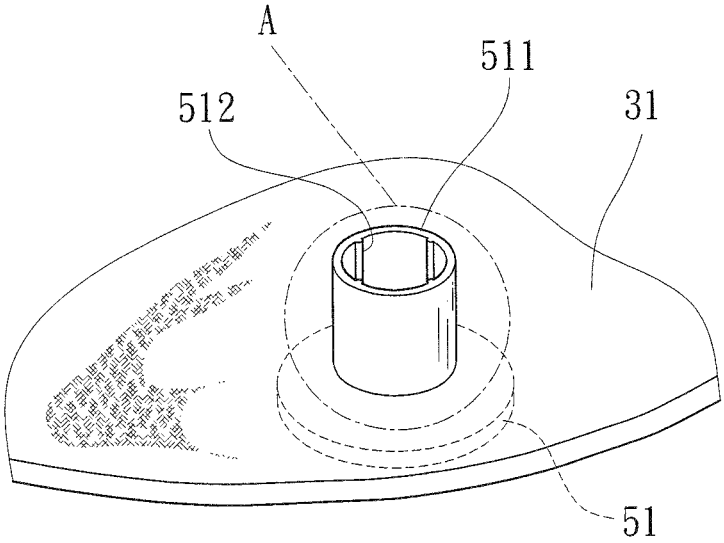
FIG. 6 shows an enlarged view of the hollow tube of the female button of the present invention.

Referring to FIGS. 4, 5, and 6, to achieve such an effect of absolute tightness of engagement between the plastic locking device 4 and the surface material 31, the rivet fastener element is structured so that the female button 51 comprises a hollow tube 511 that has an inner wall provided with locking blocks 512 projecting toward a center thereof, whereby when the male button 50 and the female button 51 use pressurizing equipment to couple the pillar 501 and inner wall of the hollow tube 511 with interference fitting for assembling purposes, the locking blocks projecting inside the hollow tube induces a tapping like interference for tight bonding to the pillar of the male button, thereby realizing excellent and fight securing effect, making the plastic locking device securely coupled to the surface material to provide a gap-free water-tight effect. After implementing this method, the plastic locking device 40 is fixed on a surface of the surface material 31, and protruded thickness of the locking device after assembling is very thin.

Since the plastic locking device 40 has a thickness that is extremely small, in order to ensure an effect of highly tight coupling between the plastic locking device and the surface material 31, a regular river fastener can be easily damaged when the plastic locking device 40 bears a great tension force in the use thereof due to the fact that the pillar of the male button of the regular rivet fastener and hollow tube of the female button only undergo ordinary interference fitting with respect to each for riveting and fixing. On the other hand, the rivet fastener element according to the present invention is made of metal zinc and the hollow tube of the female button forms locking blocks 512 that project toward the center to thereby achieve a tapping like tight engagement between the female button and the plate body of the male button.

Accordingly, the present invention uses a different structure to firmly assemble the plastic locking device on the surface material in flat, so as to improve beauty of appearance after assembling the plastic locking device, facilitate an insertion and assembling of a male button, and enable the assembling of female buttons in manufacturing a backpack, bag, or cloth cover product to be more beautiful for improving quality of the products. Furthermore, the plastic locking device of present invention is assembled without sewing, and hence is provided with an advantage of better water-proof capability.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An assembled structure of a plastic locking device and a surface material, which comprises a plastic locking device, a rivet fastener, and a surface material in the form of a flexible sheet, characterized in that:

the plastic locking device has a peripheral that forms a through-hole;

the surface material forms a hole; and the rivet fastener element comprises a female button and a male button, the male button having a plate body that is provided with a protruded pillar having a smooth cylindrical circumferential surface, the female button comprising a plate body and a hollow tube that has an inner circumferential wall extending in an axial direction from the plate body of the female button toward the protruded pillar of the male button and forming locking blocks projecting toward a center, the hollow tube of the female button having a free end that is distant from the plate body of the female button and forms an opening that receives insertion of the protruded pillar of the male button into the hollow tube, the locking blocks being in the form of ribs that extend axially and are distributed circumferentially on the inner circumferential wall of the hollow tube to establish force interference between the ribs of the hollow tube and the smooth cylindrical circumferential surface of the protruded pillar;

wherein the plastic locking device is positionable on the surface material with the through-hole of the plastic locking device overlapping the hole of the surface material and the female button is positionable on the surface material to have the hollow tube transfixed into the through-hole of the plastic locking device and the hole of the surface material, the male button being arranged to have the protruded pillar align with the opening of the hollow tube of the female button and adapted to receive a punch pin to apply a force thereto such that the protruded pillar of the male button is forced into the hollow tube of the female button to have the rivet fastener element riveted to connect the plastic locking device with the surface material thereby making the plastic locking device tightly set and coupled to the surface material;

wherein the rivet fastener element is made of zinc; and wherein the plastic locking device and the rivet fastener are free of threading so that operation of assembling the plastic locking device with a surface material is done without threading coupling.

* * * * *